US010738452B2

(12) United States Patent
Kashirajima et al.

(10) Patent No.: US 10,738,452 B2
(45) Date of Patent: Aug. 11, 2020

(54) FLUSH TOILET

(71) Applicant: TOTO LTD., Kitakyushu-shi, Fukuoka (JP)

(72) Inventors: Shu Kashirajima, Kitakyushu (JP); Masaaki Momoe, Kitakyushu (JP); Yuuki Shinohara, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/853,284

(22) Filed: Dec. 22, 2017

(65) Prior Publication Data

US 2018/0179747 A1 Jun. 28, 2018

(30) Foreign Application Priority Data

Dec. 26, 2016 (JP) ..... 2016-251815

(51) Int. Cl.

| | |
|---|---|
| ***E03D 11/08*** | (2006.01) |
| ***E03D 1/28*** | (2006.01) |
| ***E03D 9/14*** | (2006.01) |
| ***E03D 3/00*** | (2006.01) |

(52) U.S. Cl.

CPC ..... *E03D 11/08* (2013.01); *E03D 1/28* (2013.01); *E03D 9/14* (2013.01); *E03D 3/00* (2013.01)

(58) Field of Classification Search

CPC ..... E03D 11/08

USPC ..... 4/420

See application file for complete search history.

(56) References Cited

U.S. PATENT DOCUMENTS

| | | | | |
|---|---|---|---|---|
| 6,115,853 | A | 9/2000 | Shibata et al. | |
| 6,651,266 | B1 | 11/2003 | Liu et al. | |
| 2015/0275494 | A1* | 10/2015 | Kashirajima | E03D 11/08 4/420 |

FOREIGN PATENT DOCUMENTS

| | | | |
|---|---|---|---|
| CN | 1261637 | A | 8/2000 |
| JP | 2010-255316 | A | 11/2010 |
| JP | 5592617 | B2 | 9/2014 |
| JP | 2015-183485 | A | 10/2015 |
| TW | 350892 | B | 1/1999 |

OTHER PUBLICATIONS

Machine English translation of JP 5592617 B2, printed Mar. 5, 2019 (Year: 2010).*

An Office Action mailed by the State Intellectual Property Office of the People's Republic of China on Jul. 30, 2019, which corresponds to Chinese Patent Application No. 201711268920.1 and is related to U.S. Appl. No. 15/853,284; with English translation.

* cited by examiner

*Primary Examiner* — Christine J Skubinna

(74) *Attorney, Agent, or Firm* — Studebaker & Brackett PC

(57) ABSTRACT

Disclosed is a flush toilet including: a bowl portion having a waste-receiving surface and a rim; a drain passage; a rim spout section provided in the rim; and a water-conducting passage configured to supply the flush water to the rim spout section. The bowl portion has a front region and a rear region, and the rim spout section includes: a rim water passage formed inside the rim; and the rim spout port formed at a downstream end of the rim water passage. The rim water passage is provided to extend from either one of right and left parts of the rim to the remaining one of the right and left parts of the rim, via a front end of the rim. Further, the rim water passage has, in the front region of the bowl portion, a cross-sectional area constant zone.

3 Claims, 6 Drawing Sheets

FLUSH TOILET

TECHNICAL FIELD

The present invention relates to a flush toilet, and more particularly to a flush toilet which is flushed with flush water supplied from a flush water source to discharge waste.

BACKGROUND ART

There has been known a flush toilet designed to be flushed using flush water supplied from a flush water source to discharge waste, as described, for example, in Patent Document 1 (JP 5592617 B) and Patent Document 2 (JP 2015-183485 A). Conventional flush toilets described in the Patent Documents 1 and 2 are configured to spout flush water rearwardly from a rim spout port disposed at one position, in a forward-rearward directional intermediate region of a lateral part of a rim of a bowl portion, or in a region rearward of the intermediate region.

Further, in these conventional flush toilets, a rim water passage is formed inside a left part of the rim of the bowl portion in such a manner as to be supplied with flush water from a water-conducting passage on a rear side of the bowl portion. Then, the rim water passage is formed to extend up to the rim spout port in a right part of the rim of the bowl portion via a front end of the rim of the bowl portion, along a circumferential shape of the rim.

SUMMARY OF INVENTION

Technical Problem

However, in the conventional flush toilets described in the Patent Documents 1 and 2, the rim water passage is formed to extend up to the rim spout port in the right part of the rim of the bowl portion via the front end of the rim of the bowl portion, along the circumferential shape of the rim, so that the overall length of the rim water passage is increased. As a result, the volume of the entire internal space of the rim water passage is increased, and the an air space as a remaining part of the internal space of the rim water passage other than flush water during water passing is also increased.

Thus, as the volume of the entire internal space of the rim water passage becomes larger, an amount of air entrainable by flush water in the rim water passage during water passing becomes larger. If the volume of air entrainable by flush water is increased, abnormal noise is likely to be generated when the entrained air is separated from the flush water. Particularly, when flush water turns around a part of the rim water passage inside the front end of the rim, the speed and direction of the flush water are largely changed due to a relatively small curvature radius of the part of the rim water passage, which is more likely to result in occurrence of the separation of air and thus the generation of abnormal noise.

When the flow rate of flush water in the rim water passage is reduced to solve the above problem, there are some cases where flush water spouted from the rim spout port fails to form a swirl flow capable of turning around once on a waste-receiving surface.

Therefore, the present invention has been made to solve the above problems of the conventional toilets, and an object thereof is to provide a flush toilet capable of suppressing the occurrence of abnormal noise, in a front region of the bowl portion including the front end of the rim where the separation of air is more likely to occur during water passing, while maintaining a flow rate of flush water necessary for formation of a swirl flow.

Solution to Technical Problem

In order to achieve the above object, the present invention provides a flush toilet which is flushed with flush water supplied from a flush water source to discharge waste. The flush toilet comprises: a bowl portion having a bowl-shaped waste-receiving surface, and a rim formed along an upper edge of the waste-receiving surface; a drain passage connected to a bottom of the bowl portion and configured to discharge the waste therethrough; a rim spout section provided in the rim and configured to spout flush water onto the bowl portion to form a swirl flow; and a water-conducting passage configured to supply the flush water supplied from the flush water source to the rim spout section, wherein the bowl portion has a front region on a front side with respect to a center line extending in a rightward-leftward direction and dividing the bowl portion into two halves in a forward-rearward direction, a rear region on a rear side with respect to the center line; and the rim spout section comprises: a rim water passage formed inside the rim of the bowl portion and configured to allow flush water supplied from the water-conducting passage to pass therethrough; and and a rim spout port formed at a downstream end of the rim water passage and configured to spout flush water rearwardly, and the rim water passage is provided in the rim to extend from either one of right and left parts of the rim in the rear region of the bowl portion to the remaining one of the right and left parts of the rim of the bowl portion, via a front end of the rim, wherein the rim water passage has, in the front region of the bowl portion including the front end of the rim, a cross-sectional area constant zone in which a cross-sectional area of the rim water passage taken along a plane orthogonal to a flow direction of flush water in the rim water passage is constant.

In the flush toilet of the present invention configured as above, in the front region of the bowl portion including the front end of the rim, the rim water passage has a cross-sectional area constant zone in which a cross-sectional area of the rim water passage taken along a plane orthogonal to a flow direction of flush water in the rim water passage is constant. Thus, in the cross-sectional area constant zone, there is no change in internal volume of the rim water passage, so that it becomes possible to keep constant an area for allowing flush water to flow therethrough, and prevent an air space as a space other than the flush water area from increasing or decreasing in an intermediate part of the rim water passage. That is, in the front region of the bowl portion including the front end of the rim where the rim water passage has the smallest curvature radius and thereby the separation of air is more likely to occur, it becomes possible to reduce a useless space, and thus reduce an amount of air entrainable by flush water during water passing, as compared to the case where the cross-sectional area of the rim water passage taken along a plane orthogonal to the flow direction changes such that the internal volume of the rim water passage is increased.

This makes it possible to suppressing the occurrence of abnormal noise in the front region of the bowl portion including the front end of the rim where the separation of air is more likely to occur during water passing, while maintaining a flow rate of flush water necessary for formation of a swirl flow.

Preferably, in the flush toilet of the present invention, the cross-sectional area constant zone of the rim water passage includes a zone provided, along the flow direction of flush water, over a range from a start point located in either one of right and left parts of the front region of the bowl portion and having a relatively large curvature radius, to an end point located in the remaining one of the right and left parts of the front region of the bowl portion and having a relatively large curvature radius, wherein a curvature radius of the rim water passage changes to become smaller as getting away from the start point and then changes to becomes larger from the smallest curvature radius after going through the front end of the rim until reaching the end point.

According to this feature, a section of the rim water passage located in the front region of the bowl portion including the front end of the rim where the rim water passage has a relatively small curvature radius and thereby the separation of air due to centrifugal force is more likely to occur can be included in the cross-sectional area constant zone.

This makes it possible to further suppress the occurrence of abnormal noise in the front region of the bowl portion including the front end of the rim where the separation of air is more likely to occur during water passing.

Preferably, in the flush toilet of the present invention, the rim spout port is formed in the front region of the bowl portion.

According to this feature, the rim spout port is formed in the front region of the bowl portion. Thus, as compared to the case where the rim spout port is formed in the rear region of the bowl portion, the overall length of the rim water passage can be reduced, so that it becomes possible to reduce the volume of the rim water passage and thus reduce an amount of air in the rim water passage. This makes it possible to suppress the occurrence of abnormal noise which would otherwise be caused by the separation of air.

Preferably, in the above flush toilet, the rim water passage has a bottom surface which extends from the cross-sectional area constant zone to the rim spout port, while being inclined downwardly toward the rim spout port.

According to this feature, the rim water passage has a bottom surface which extends from the cross-sectional area constant zone to the rim spout port, while being inclined downwardly toward the rim spout port. Thus, flush water flowing through the rim water passage is less likely to remain in a part of the rim water passage between the cross-sectional area constant zone and the rim spout port, upon termination of water spouting from the rim spout port, so that it becomes possible to suppress the occurrence of contamination and odor which would otherwise be caused by residual water in the rim water passage, while suppressing the occurrence of abnormal noise in the front region of the bowl portion including the front end of the rim where the separation of air is more likely to occur during water passing.

As above, the present invention makes it possible to suppress the occurrence of abnormal noise, in the front region of the bowl portion including the front end of the rim where the separation of air is more likely to occur during water passing, while maintaining a flow rate of flush water necessary for formation of a swirl flow.

DESCRIPTION OF EMBODIMENTS

With reference to the drawings, a flush toilet according to one embodiment of the present invention will now be described.

First of all, a basic structure of the flush toilet according to this embodiment will be described with reference to FIGS. 1 to 3.

Figure 1:
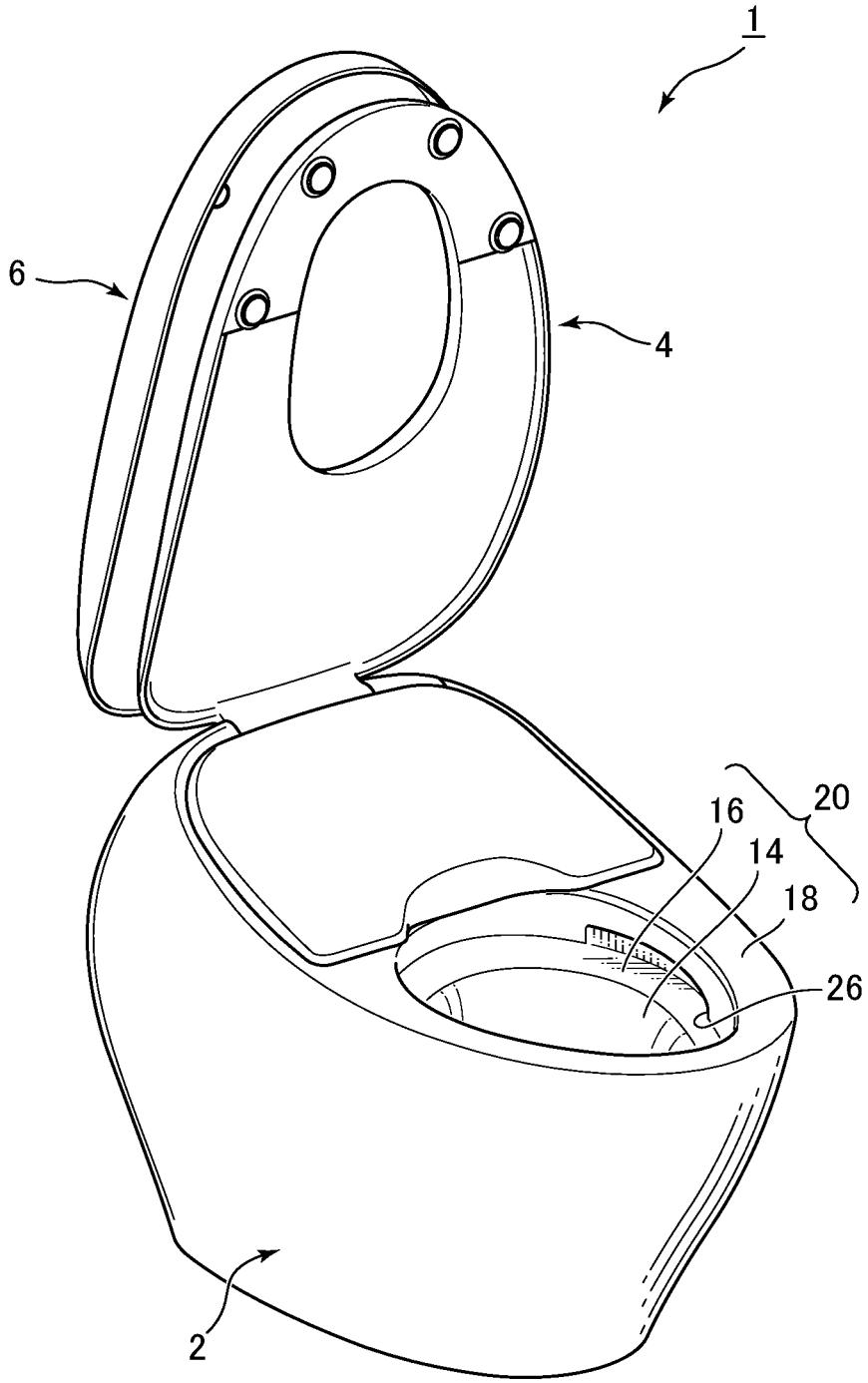
FIG. 1 is a perspective view depicting a flush toilet according to one embodiment of the present invention.
Figure 2:
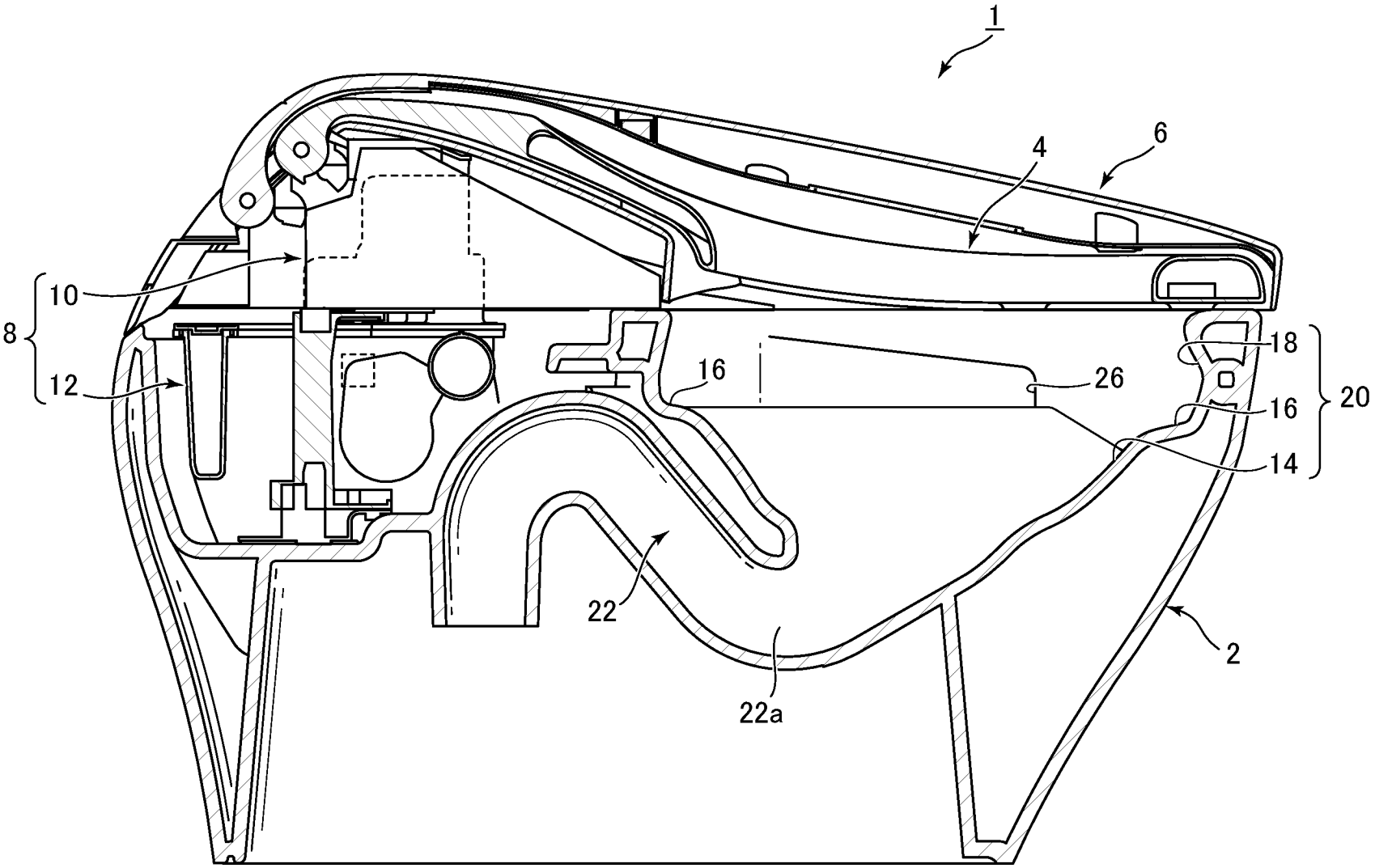
FIG. 2 is a sectional view of the flush toilet according to this embodiment.
Figure 3:
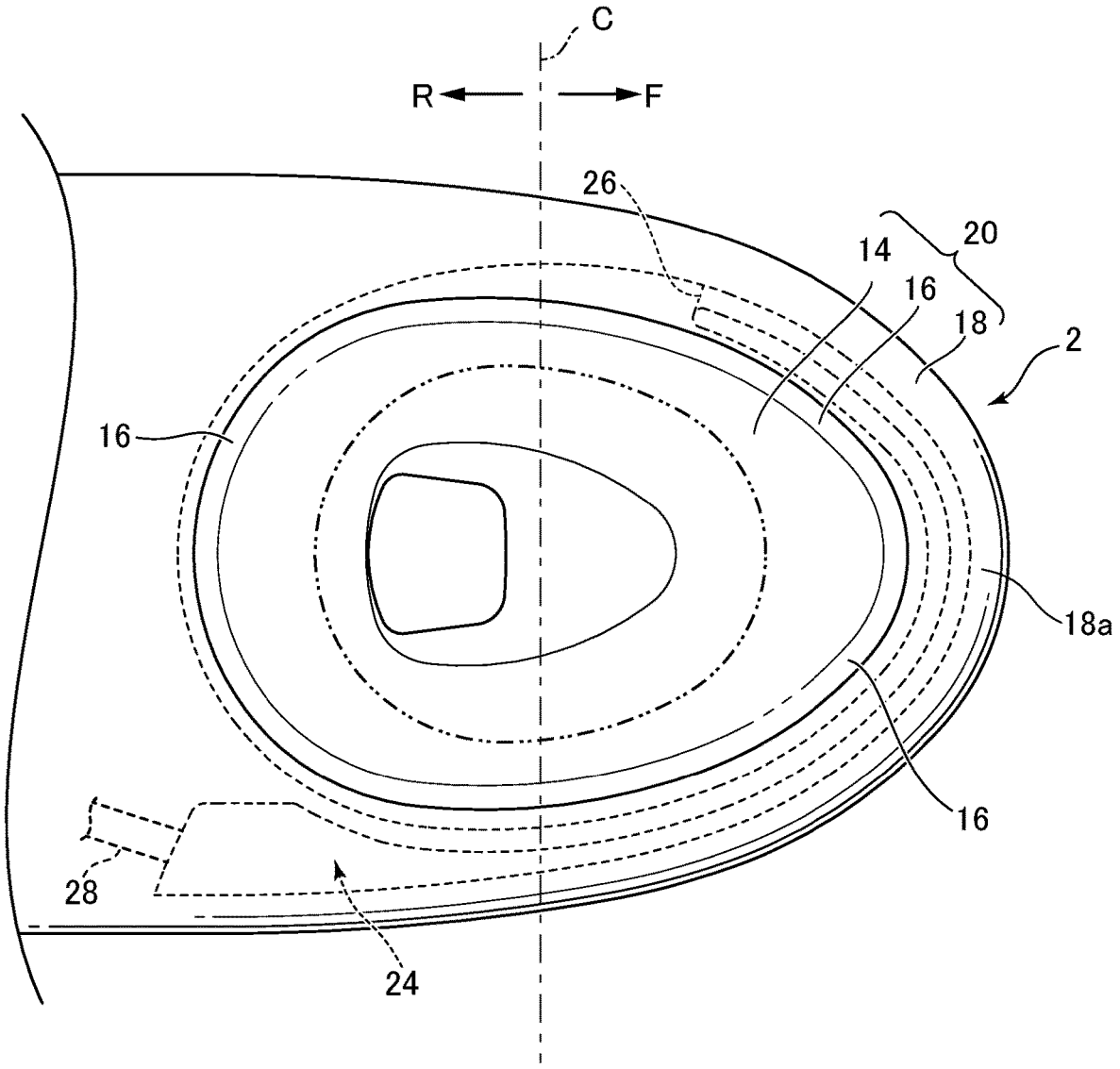
FIG. 3 is a fragmentary top plan view of the flush toilet according to this embodiment depicted in FIG. 1.

As depicted in FIGS. 1 to 3, the flush toilet 1 according to this embodiment comprises: a toilet main unit 2 made of a ceramic material; a toilet seat 4 placed on a top surface of the toilet main unit 2 in such a manner as to be swingable in an upward-downward direction; a toilet cover 6 disposed to cover the toilet seat 4 in such a manner as to be swingable in the upward-downward direction; and a functional unit 8 disposed rearward of the toilet main unit 2.

As depicted in FIG. 2, the functional unit 8 comprises a sanitary cleaning system-related functional unit 10 disposed rearward of an upper region of the toilet main body 2 and configured to clean a local part of a user, and a water feeding system-related functional unit 12 disposed in adjacent relation to the sanitary cleaning system-related functional unit 10 and configured to feed water to the toilet main body 2.

As depicted in FIGS. 1 to 3, the toilet main unit 2 comprises a bowl portion 20. The bowl portion 20 has a bowl-shaped waste-receiving surface 14, a shelf surface 16 formed at an upper edge of the waste-receiving surface 14, and a rim 18 formed to stand upwardly from the shelf surface 16.

As depicted in FIG. 2, the toilet main unit 2 is provided with a drain trap conduit 22 which is a drain passage for discharging waste in the bowl portion 20. The drain trap conduit 22 has an inlet port 22*a* connected to a bottom of the bowl portion 20.

In this flush toilet 1, specific structures of the sanitary cleaning system-related functional unit 10 and the water feeding system-related functional unit 12 are the same as those in conventional flush toilets, and therefore description thereof will be omitted.

As depicted in FIG. 3, the bowl portion 20 has a front region F on a front side with respect to a center line C extending in a rightward-leftward direction and dividing the bowl portion 20 into two halves in a forward-rearward direction, and a rear region R on a rear side with respect to the center line C. Further, the bowl portion 20 has a rim water passage 24 formed inside the rim 18 thereof.

More specifically, the rim water passage 24 is formed to extend from a left part of the rim 18 in the rear region R of the bowl portion 20, when viewed rearwardly from a position forward of the toilet main unit 2, to a right part of the rim 18 in the front region F of the bowl portion 20, when viewed rearwardly from a position forward of the toilet main unit 2, via a front end 18*a* of the rim 18. Further, a rim spout port 26 is formed at a downstream end of the rim water passage 24.

In this embodiment, the rim water passage 24 and the rim spout port 26 are formed integrally with the toilet main unit 2 and defined by a ceramic forming the toilet main unit 2.

As depicted in FIG. 3, the rim water passage 24 has an upstream end connected to a water-conducting duct 28 which is a water-conducting passage for supplying, to the rim water passage 24, flush water fed from a water system (not depicted) serving as a flush water source. The rim spout port 26 is opened to connect to the shelf surface 16 formed between the rim and the waste-receiving surface 14.

An upstream end of the water-conducting duct 28 is directly connected to the water system (not depicted) serving as a flush water source, to enable flush water to be supplied from the the water-conducting duct 28 into the rim spout passage 24 and led to the rim spout port 26 through the rim water passage 24 formed along a shape of the rim 18, by means of a water feed pressure of the water system.

Then, the flush water led to the rim spout port 26 is spouted onto the bowl portion rearwardly and swirled around the bowl portion 20 to thereby form a swirl flow in the bowl portion 20.

In the flush toilet 1 according to this embodiment, a spout port provided in the rim 18 and configured to spout flush water to form a swirl flow in the bowl portion 20 is only one rim spout port 26.

Although the flush toilet 1 according to this embodiment is configured such that flush water flows through the rim water passage 24 in a counterclockwise direction, the present invention is not limited to this configuration, but may be configured such that flush water flows through the rim water passage in a clockwise direction. In this case, the rim water passage 24 is formed inside the rim 18 to extend from a right part of the rim 18 in the rear region R of the bowl portion 20, in a clockwise direction along the shape of the rim. Further, when viewed rearwardly from a position forward of the toilet main unit 2, the rim spout port 26 is formed inside a left part of the rim 18 in the front region F of the bowl portion 20, to spout flush water rearwardly.

Basically, in this embodiment, the rim water passage may be formed to extend from either one of right and left parts of the rim 18 of the bowl portion 20 to the remaining one of the right and left parts of the rim 18 of the bowl portion 20, via the front end 18*a* of the rim 18, along the shape of the rim 18, and the rim spout port may be disposed in the remaining one of the right and left parts of the rim 18 of the bowl portion 20 and configured to spout flush water onto the bowl portion 20 rearwardly.

Next, with reference to FIGS. 4 to 7, the rim water passage 24 of the flush toilet 1 according to this embodiment will be described in more detail.

Figure 4:
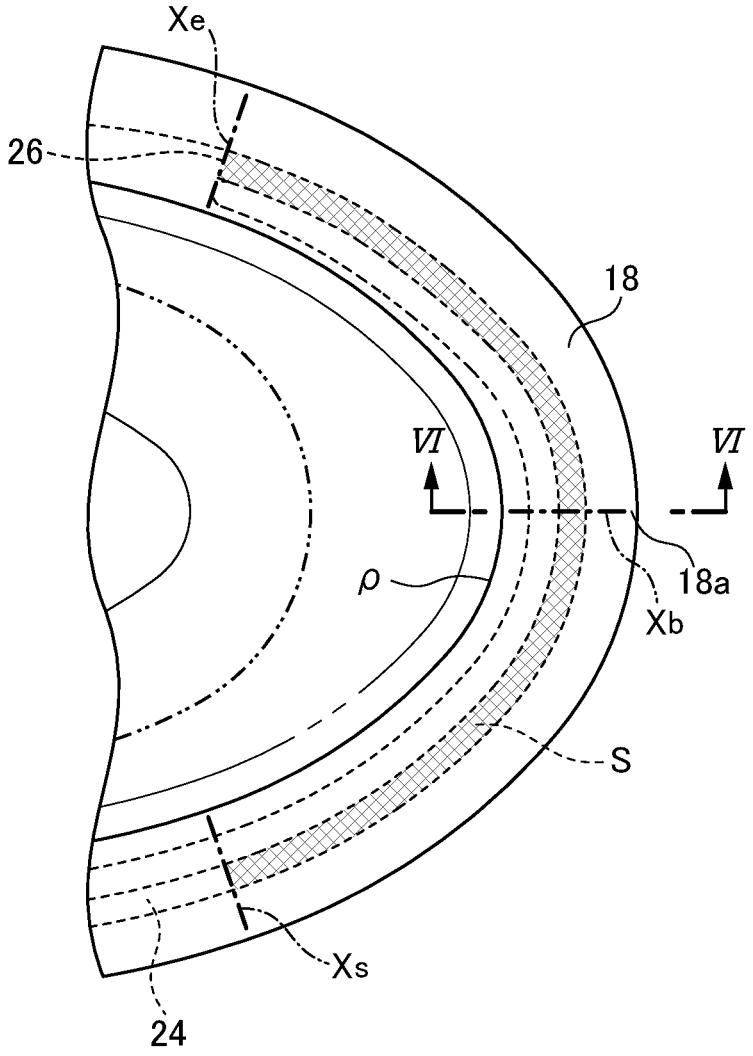
FIG. 4 is a partially-enlarged top plan view depicting a front region of the bowl portion of a toilet main unit in the flush toilet according to this embodiment depicted in FIG. 3.

As depicted in FIG. 4, the rim water passage 24 has a cross-sectional area constant zone S which is a zone lying within the front region F of the bowl portion 20 and ranging from a start point Xs to an end point Xe while including the front end 18*a* of the rim 18. As used herein, the term "cross-sectional area constant zone" means a zone in which a cross-sectional area of the rim water passage 24 taken along a plane orthogonal to a flow direction of flush water in the rim water passage 24 is constant. In this embodiment, the end point Xe is set at the same position as the rim spout port 26 which is the downstream end of the rim water passage 24.

In the cross-sectional area constant zone S of the rim water passage 24, there is no change in internal volume of the rim water passage 24, so that it is possible to keep constant an area for allowing flush water to flow therethrough and prevent an air space as a space other than the flush water area from increasing or decreasing in an intermediate part of the rim water passage 24. Generally, the curvature radius ρ of the rim water passage 24 becomes smallest at the front end 18*a* of the rim 18. Thus, the front end 18*a* of the rim 18 is a position where the separation of air causing the generation of abnormal sound is more likely to occur. In this embodiment, in the front region F of the bowl portion 20 including the front end 18*a* of the rim 18, the cross-sectional area constant zone S is provided in the rim water passage 24, so that it is possible to enable flush water flowing through the rim water passage 24 to orderly pass therethrough to thereby reduce changes in flow rate and direction of flush water, as compared to the case where the cross-sectional area of the the rim water passage 24 changes to increase the internal volume of the rim water passage 24.

As a result, it becomes possible to suppress the occurrence of abnormal noise, in the cross-sectional area constant zone S within the front region F of the bowl portion 20 including the front end 18*a* of the rim 18 where the separation of air is more likely to occur during water passing, while maintaining a flow rate of flush water necessary for formation of a swirl flow.

As used herein, the phrase "cross-sectional area is constant" includes an "approximately constant" state in which changes in flow rate and direction of flush water can be reduced to suppress the occurrence of abnormal noise.

Figure 5:
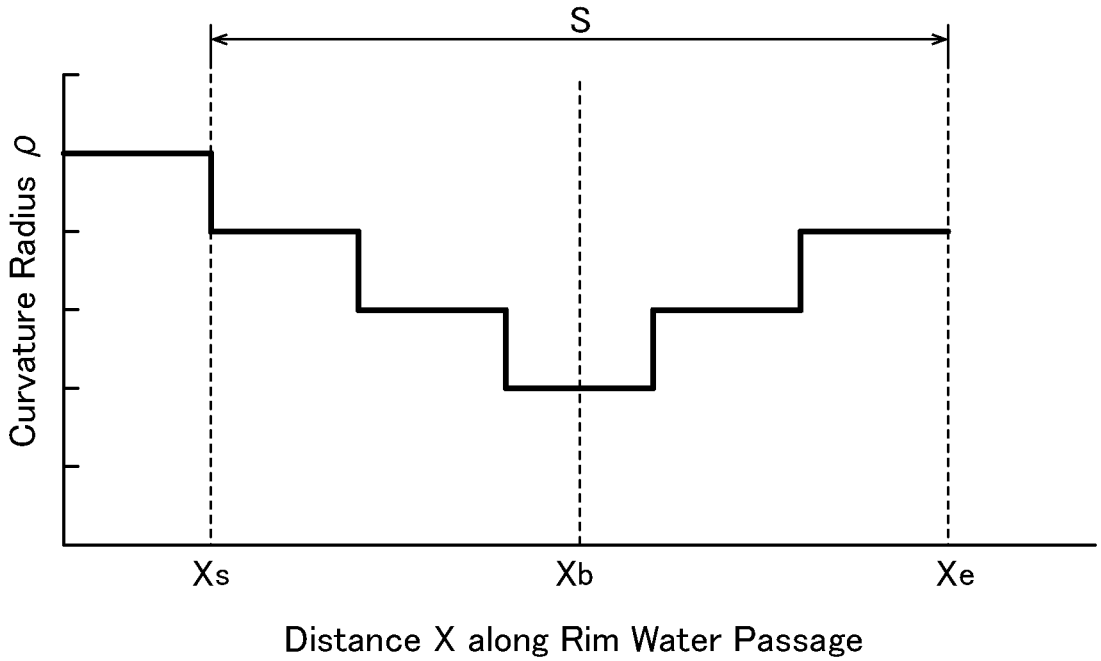
FIG. 5 is a chart presenting a relationship between a position of (a distance X along) and a curvature radius ρ of a rim water passage in the flush toilet according to this embodiment.

As depicted in FIG. 5, when viewed along the flow direction of flush water flowing through the rim water passage 24, in the front region F of the bowl portion 20, the curvature radius ρ of the rim water passage 24 in a horizontal direction gradually becomes smaller as getting away from the start point Xs and becomes smallest at a midpoint Xb which is the front end 18*a* of the rim 18, whereafter the curvature radius ρ gradually becomes larger as getting away from the midpoint Xb until reaching the end point Xe.

That is, the cross-sectional area constant zone S of the rim water passage 24 is provided, along the flow direction of flush water, over a range from a start point located in the left part of the front region F of the bowl portion 20 and having a relatively large curvature radius ρ, to an end point located in the right part of the front region F of the bowl portion and having a relatively large curvature radius ρ, wherein the curvature radius ρ changes to become smaller as getting away from the start point and then changes to becomes larger from the smallest curvature radius ρ after going through the front end 18*a* of the rim 18 until reaching the end point.

Therefore, in the rim water passage 24 located in the front region F of the bowl portion 20, it is possible to enable flush water to orderly pass therethrough over the entire range from the start point to the end point in terms of a change in curvature radius ρ of the rim water passage 24, in which the separation of air due to changes in flow rate and direction of flush water is more likely to occur, to thereby reduce changes in flow rate and direction of flush water, as compared to the case where the cross-sectional area of the rim water passage 24 changes to increase the internal volume of the rim water passage 24, and thus suppress the occurrence of abnormal noise.

Figure 6:
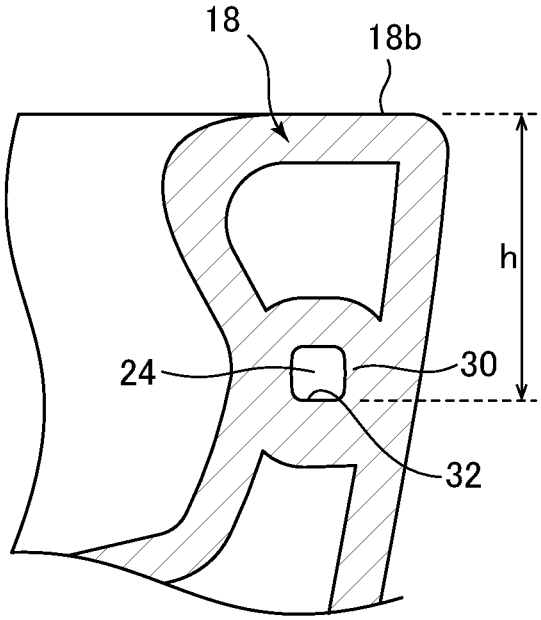
FIG. 6 is a partially-enlarged sectional view of a rim of the bowl portion, taken along the line VI-VI in FIG. 4.

As depicted in FIG. 6, the cross-sectional area constant zone S of the rim water passage 24 is defined by an inner wall 30 of the rim 18 defining the rim water passage 24. More specifically, the cross-sectional area constant zone S of the rim water passage 24 is integral with the remaining part of the rim water passage 24, and defined by part of the ceramic forming the rim 18. In this way, the cross-sectional area constant zone S of the rim water passage 24 is fully defined by the ceramic, so that, as compared to the case where it is defined using a separate member, it is possible to prevent contamination from accumulating between the separate member and the inner wall 30 of the rim 18, thereby providing enhanced hygienic performance.

Alternatively, the cross-sectional area constant zone S of the rim water passage 24 may be defined by inserting a hose (flexible pipe; not depicted) into the inner wall 30 of the rim 18 to thereby define a part of the rim water passage 24. As compared to a ceramic, the hose is relatively small in terms of a variation in cross-sectional area of the rim water passage 24 taken along a plane orthogonal to the flow direction. Thus, as compared to the case where the cross-sectional area constant zone S of the rim water passage 24 is defined by a ceramic, it becomes possible to easily and accurately define the cross-sectional area constant zone S.

Although the cross section of of the rim water passage 24 taken along a plane orthogonal to the flow direction has a rectangular shape in this embodiment, it may have a circular shape or the like.

Figure 7:
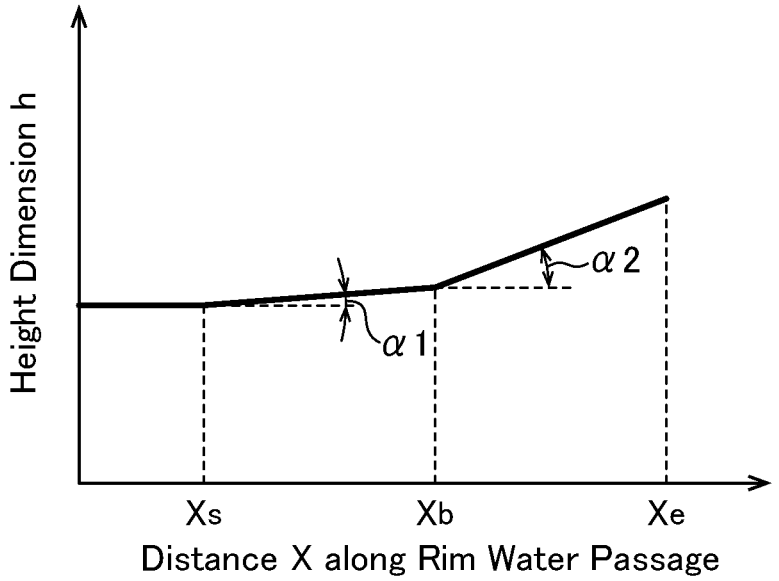
FIG. 7 is a chart presenting a relationship between the position of (a distance along) the rim water passage and a height (height dimension n) of a bottom surface of the rim water passage from a top surface of the rim, in the flush toilet according to this embodiment.

Further, as depicted in FIGS. 6 and 7, when denoting, by h, a height dimension from a bottom surface 32 of the rim water passage 24 to a top surface 18*a* of the rim 18, the height dimension h from the bottom surface 32 of the rim water passage 24 to the top surface 18*a* of the rim 18 gradually increases from the start point Xs to the end point Xe.

In other words, the bottom surface 32 of the rim water passage 24 extends from the start point Xs of the cross-sectional area constant zone S of the rim water passage 24 to the end point Xe at which the rim spout port 26 is formed, while being inclined downwardly toward the rim spout port 26.

Specifically, the bottom surface 32 of the rim water passage 24 is inclined downwardly at an inclination angle of $\alpha 1$, and then inclined downwardly at an inclination angle of $\alpha 2$, from the midpoint Xb which is the front end 18*a* of the rim 18.

In this case, the inclination angle $\alpha 1$ and the inclination angle $\alpha 2$ are preferably set, respectively, in the range of 1 to 5 degrees and in the range of 1 to 7 degrees, and more preferably set, respectively, in the range of 1.5 to 3 degrees and in the range of 2 to 4 degrees.

The rim water 24 is formed in this manner, so that flush water flowing through the rim water passage 24 is less likely to remain in a part of the rim water passage 24 between the cross-sectional area constant zone S and the rim spout port 26, upon termination of water spouting from the rim spout port 26.

Thus, it becomes possible to suppress the occurrence of contamination and odor which would otherwise be caused by residual water in the rim water passage 24, while suppressing the occurrence of abnormal noise in the front region F of the bowl portion 20 including the front end 18*a* of the rim 18 where the separation of air is more likely to occur during water passing.

Further, the inclination angles are set to be $\alpha 1<\alpha 2$, i.e., the bottom surface 32 of the rim water passage 24 is more largely inclined toward a downstream side, so that it becomes possible to further suppress stay of flush water in a downstream area of the rim water passage 24 where momentum of a flow of flush water becomes weak.

Next, functions/effects of the flush toilet 1 according to the above embodiment will be described.

In the flush toilet 1 according to the above embodiment, in the front region F of the bowl portion 20, the rim water passage 24 has the cross-sectional area constant zone S which includes the front end 18*a* of the rim 18 and in which the cross-sectional area of the rim water passage 24 taken along a plane orthogonal to the flow direction is constant. Thus, in the cross-sectional area constant zone S of the rim water passage 24, there is no change in internal volume of the rim water passage 24, so that, in the flush toilet 1, it becomes possible to keep constant an area for allowing flush water to flow therethrough, and thereby suppress the occurrence of large abnormal noise which would otherwise be generated when air entrained in flush water is separated from the flush water. More specifically, in the front region F of the bowl portion 20 including the front end 18*a* of the rim 18 where the rim water passage 24 has the smallest curvature radius $\rho$ and thereby the separation of air is more likely to occur, it becomes possible to enable flush water flowing through the rim water passage 24 to orderly pass therethrough to thereby reduce changes in flow rate and direction of flush water, as compared to the case where the internal volume of the the rim water passage 24 changes.

As a result, it becomes possible to suppress the occurrence of abnormal noise, in in the front region F of the bowl portion 20 including the front end 18*a* of the rim 18 where the separation of air is more likely to occur during water passing, while maintaining a flow rate of flush water necessary for formation of a swirl flow.

In the flush toilet 1 according to the above embodiment, the cross-sectional area constant zone S of the rim water passage 24 includes, along the flow direction of flush water, a zone in which the curvature radius $\rho$ of the rim water passage 24 changes to become smaller as getting away from the start point located in the left part of the front region F of the bowl portion 20 and having a relatively large curvature radius $\rho$, and then changes to becomes larger from the smallest curvature radius $\rho$ after going through the front end 18*a* of the rim 18 until reaching the end point located in the right part of the front region F of the bowl portion and having a relatively large curvature radius $\rho$. This makes it possible to more effectively suppress the occurrence of abnormal noise, in an area where the curvature radius $\rho$ of the rim water passage 24 changes to become smaller and thereby the separation of air is more likely to occur.

In the flush toilet 1 according to the above embodiment, the rim spout port 26 is formed in the front region F of the bowl portion 20, so that, as compared to the case where the rim spout port 26 is formed in the rear region R of the bowl portion 20, the overall length of the rim water passage 24 can be reduced, and thereby it becomes possible to reduce the volume of the rim water passage 24 and thus reduce an amount of air in the rim water passage 24. This makes it possible to suppress the occurrence of abnormal noise which would otherwise be caused by the separation of air.

In the flush toilet 1 according to the above embodiment, the bottom surface 32 of the rim water passage 24 extends from the cross-sectional area constant zone S of the rim water passage 24 to the rim spout port 26, while being inclined downwardly toward the rim spout port 26. Thus, flush water flowing through the rim water passage 24 is less likely to remain in a part of the rim water passage 24 between the cross-sectional area constant zone S and the rim spout port 26, upon termination of water spouting from the rim spout port 26, so that it becomes possible to suppress the occurrence of contamination and odor which would otherwise be caused by residual water in the rim water passage 24, while suppressing the occurrence of abnormal noise in the front region F of the bowl portion 20 including the front end 18*a* of the rim 18 where the separation of air is more likely to occur during water passing.

What is claimed is:

1. A flush toilet which is flushed with flush water supplied from a flush water source to discharge waste, comprising:

a bowl portion having a bowl-shaped waste-receiving surface, a shelf surface formed at an upper edge of the waste-receiving surface, and a rim formed to stand upwardly from the shelf surface;

a drain passage connected to a bottom of the bowl portion and configured to discharge the waste therethrough;

a rim water passage provided in the rim and configured to spout flush water onto the bowl portion to form a swirl flow; and a water-conducting passage configured to supply the flush water supplied from the flush water source to the rim water passage, wherein the bowl portion has a front region on a front side with respect to a center line extending in a rightward-leftward direction and dividing the bowl portion into two halves in a forward-rearward direction, and a rear region on a rear side with respect to the center line, the rim water passage is provided to extend from either one of right and left parts of the rim in the rear region of the bowl portion to the remaining one of the right and left parts of the rim of the bowl portion, and formed inside the rim of the bowl portion and configured to allow flush water supplied from the water-conducting passage to pass therethrough, the rim water passage has a cross-sectional area constant zone in which a cross-sectional area thereof taken along a plane orthogonal to a flow direction of flush water in the rim water passage is constant, and a rim spout port which is formed at a downstream end of the cross-sectional area constant zone of the rim water passage, and configured to spout flush water rearwardly onto the shelf surface, the cross-sectional area constant zone and the rim spout port are located in the front region of the bowl portion and not located in the rear region of the bowl portion, the cross-sectional constant zone has a front end which has a smallest curvature radius among an entire cross-sectional area constant zone, the cross-sectional constant zone has the cross-sectional area thereof which is smaller than that of the rim water passage located upstream of the cross-sectional area constant zone, and the cross-sectional area constant zone has a bottom surface which is inclined downwardly toward the rim spout port from the start point to the end point thereof.

2. The flush toilet according to claim 1, wherein the cross-sectional area constant zone of the rim water passage includes a zone provided, along the flow direction of flush water, over a range from a start point located in either one of right and left parts of the front region of the bowl portion, to an end point located in the remaining one of the right and left parts of the front region of the bowl portion, wherein a curvature radius of the rim water passage changes to become smaller as getting away from the start point and then changes to becomes larger from a smallest curvature radius after going through the front end of the rim until reaching the end point.

3. The flush toilet according to claim 1, wherein the rim spout port is formed in the front region of the bowl portion.

* * * * *